United States Patent [19]

Hance

[11] 3,973,871

[45] Aug. 10, 1976

[54] SUMP PUMP

[75] Inventor: Pierre G. Hance, La Louvière, Belgium

[73] Assignee: Ateliers de Constructions Electriques de Charlerol (ACEC), Charleroi, Belgium

[22] Filed: Oct. 25, 1974

[21] Appl. No.: 518,175

[30] Foreign Application Priority Data

Oct. 26, 1973 Belgium ..... 806614

[52] U.S. Cl. ..... 415/198 R; 415/98

[51] Int. Cl.[2] ..... F04D 29/28

[58] Field of Search ..... 415/198, 98, 501

[56] References Cited

UNITED STATES PATENTS

| | | | |
|---|---|---|---|
| 990,507 | 4/1911 | Sulzer | 415/98 |
| 1,089,770 | 3/1914 | Kerr | 415/98 |
| 1,608,018 | 5/1928 | Hollander | 415/98 |
| 2,543,633 | 2/1951 | Lamphere | 415/98 |
| 2,661,698 | 12/1953 | Schellens | 415/98 |
| 3,671,138 | 6/1972 | Ball | 415/98 |

FOREIGN PATENTS OR APPLICATIONS

| | | | |
|---|---|---|---|
| 255,902 | 1/1913 | Germany | 415/198 |
| 638,309 | 4/1962 | Italy | 415/98 |
| 752,710 | 7/1956 | United Kingdom | 415/198 |

*Primary Examiner*—Henry F. Raduazo
*Attorney, Agent, or Firm*—Raymond A. Robic; Peter G. Mack; Arthur Schwartz

[57] ABSTRACT

A sump pump comprising a sump having an inlet for the liquid to be pumped and a discharge outlet, the pump proper being received at the bottom of the sump and being driven by a vertically mounted shaft. The pump comprises two impellers each having two intakes, the impellers being mounted one above the other on the shaft and surrounded by two volutes each having one or two outlets which are connected to the inlets of a collecting manifold, the outlet of such manifold being connected to the outlet of the sump.

4 Claims, 3 Drawing Figures

FIG. 2

SUMP PUMP

The present invention relates to sump pumps.

A sump pump is known already for use, for instance, in the transportation of petroleum by pipe line, such pump comprising a sump inlet for the liquid to be drawn out, a single vertically mounted shaft adapted to be driven by a motor, an impeller mounted on the single shaft and having at least one, generally two, intakes to draw out the liquid from the sump, a volute surrounding the impeller and having one or several outlet nozzles, a manifold of which the inlets are joined to the outlets of the volute and a sump outlet eventually connected through other stages of the pump to the outlet of the manifold. Such a pump may comprise several stages and thus several impellers, each belonging to one stage of the pump. In this known sump pump, one impeller only draws out the liquid in the sump whereas the outer impellers draw out the liquid each in a manifold connected to the volute of the preceding impeller.

The present invention relates to a new pump of this general type which for a given outlet flow and pressure head allows, as compared to known pumps of this type as above-described, either a shallower sump or a smaller sump diameter and permits operation at higher speeds of rotation. With a sump pump according to the invention, it is possible to select, more appropriately than previously, the depths and sump diameters as well as the speed of rotation of the impellers and thus minimize the bulk of the pump in given field conditions.

More specifically, the sump pump according to the invention comprises: a sump casing; a single vertical drive shaft in the sump casing; an upper impeller and a lower impeller, the impellers being mounted in vertically spaced disposition on the shaft, each impeller having a pair of intake means; an upper volute and a lower volute, each volute surrounding one impeller, each volute being of spirally, radially, outwardly extending configuration with a radially innermost portion, a radially outermost portion, and a radial gap between the innermost and outermost portions; at least one outlet in the radially outermost portion of each volute, the outlets and radially outermost portions being angularly staggered with respect to one another and so disposed that the outlet of the lower volute is immediately below the radial gap between the innermost and outermost portions of the upper volute; and a pair of pipe means, each pipe means being connected with one outlet, the one pipe means connected with the outlet of the lower volute extending through the region of the radial gap, whereby a radially compact arrangement is achieved.

An embodiment of the invention, in the form of a single-stage sump pump, is described hereinafter with reference to the appended drawings wherein.

Figure 1:
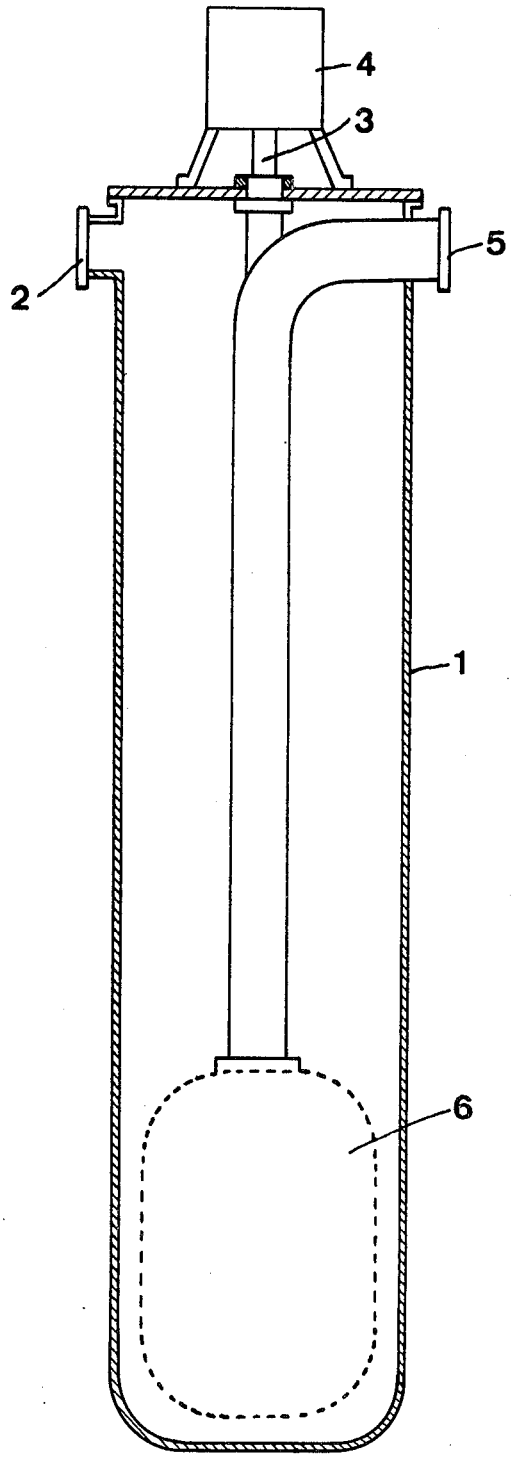
FIG. 1 is a diagrammatic elevation view of the sump pump with the sump proper being shown in vertical cross-section.
Figure 2:
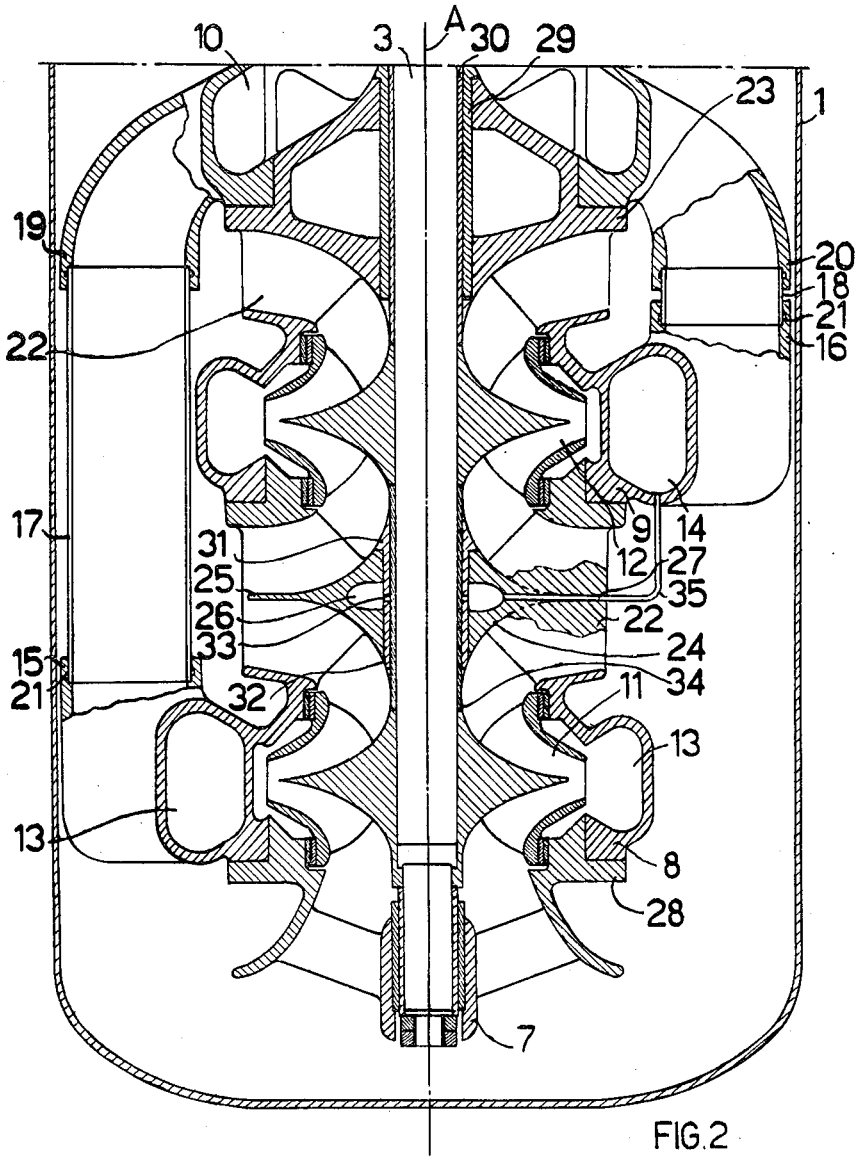
FIG. 2 shows two enlarged vertical cross-sectional views taken on either side of the longitudinal axis of the driving shaft of the pump in two different planes containing the said axis.

FIG. 1 illustrates a sump casing 1 having an inlet 2 for a liquid to be pumped and a single shaft 3 of which the axis A (FIG. 2) stands vertically in the sump casing 1. The shaft 3 is adapted to be driven by a motor 4. An outlet 5 for the overall sump pump arrangement is connected to a collecting manifold 10 forming the upper part of the pump 6 proper, illustrated in cross-section in FIG. 2. In the latter, the shaft 3 is shown mounted in a lower bearing 7 and is thus made integral with a frame formed of a stack of two pump bodies 8 and 9 and of a collecting manifold 10. The shaft 3 carries two double-intake impellers 11 and 12 respectively rotating in the pump bodies 8 and 9. The impellers 11 and 12 draw out the liquid in the sump 1 through rings of webs 22 that prevent the liquid upstream of the impellers 11 and 12 from swirling.

Each of the pump bodies 8 and 9 comprises a volute, respectively, lower volute 13 and upper volute 14. The outlets of the volutes 13 and 14 are configured as cylindrical joint seats 15 and 16, with vertical axes and provided with packings 21, such seats being adapted to receive the lower ends of removable pipes 17 and 18. The upper ends of pipes 17 and 18 are inserted in corresponding vertically extending cylindrical joint seats 19, 20, likewise provided with packings 21 and formed in the collecting manifold 10.

The impellers 11 and 12 draw out the liquid to be pumped in the sump 1 and discharge it through the volutes 13 and 14 and the pipes 17 and 18 in the manifold 10. In the illustrated embodiment, these pipes are mounted vertically. It is also possible to mount them inclined with respect to the vertical. From the collecting manifold 10, the liquid to be pumped is carried toward the outlet 5 of the sump 1, eventually through other pump stages of which the impellers are driven by the same shaft 3. Although the pressure at the level of the upper edge of the impeller 12 is smaller than at the level of the upper edge of the impeller 11, which is comparable to the single impeller of the known pumps, this reduction in the inlet pressure is more than compensated by doubling up the flow obtained in the use of two impellers.

As the pump according to the invention is intended to rotate faster than the known pumps, bearings are provided which have wear rings necessitating that they be economically removable and replaced by new ones. It is further necessary to ensure appropriate lubrication of the bearings. For this purpose, the lower wall of the collecting manifold 10 is made part of a removable member 23 having a cylindrical joint seat concentric to the axis of rotation. To this member 23 is joined the body of the upper volute 14 through webs 22. A middle removable assembly part 24 having a cylindrical seat concentric to the axis of rotation is slid into the body 9 of the upper volute 14. This central dismountable part 24 comprises a horizontal ledge 25 separating the input to the lower impeller 11 from that of the upper impeller 12. The ledge 25 is connected on one side to the part forming the joint with the body 9 of the volute 14 and is connected on the other side with the body 8 of the volute 13, through the webs 22. A cavity 26, surrounding the shaft 3, is provided in the plane of horizontal symmetry of the part 24, this cavity serving as a channel for distributing lubricating liquid. The liquid to be pumped is used as lubricant. Access to the cavity 26 is through one or several conduits 27 drilled from the outer periphery of the ledge 25 where the latter joins webs 22. On the drawing, FIG. 2, two of the webs are partially cut away at the location of the conduit 27.

An end piece 28 with cylindrical seat concentric to the axis of rotation 3 is secured to the body 8 of the volute 13. This end piece carries the bearing 7.

The removable part 23 is provided with a stationary wear ring 29 extending from the bottom of the manifold 10 up to the suction zone of the upper intake of impeller 12 whereas the shaft carries, at this point, a rotary wear ring 30.

The removable middle or center part may comprise two stationary wear rings 31 and 32. As shown in the drawing, these two rings 31 and 32 may form part of one and same mechanical part, the separation between the rings 31 and 32 being materialized by a row of holes 33 at the location of the cavity 26. The upper ring 31 extends from the central cavity 26 up to the lower suction zone of the impeller 12 and the lower ring 32 extends from the central cavity 26 up to the upper suction zone of the impeller 11. At both places, the shaft 3 is provided with a rotary wear ring 34.

Lubrication of the bearing constituted by the rings 29 and 30 results from the difference in liquid pressure between the manifold and the upper suction zone of the impeller 12.

Lubrication of the bearings constituted by the rings 31, 32 and 34 is achieved through the difference in liquid pressure between the cavity 26 and the lower suction zone of the impeller 12 or the upper suction zone of the impeller 11. The pressure of the liquid in the cavity 26 may be selected, for instance, to be equal to the pressure in the sump at the level of the ledge 25 if one or more conduits 27 are led to the outer periphery of the ledge 25 or, as is shown in the drawing, this pressure may be selected to be equal to the pressure of the liquid in the collecting manifold 10 if a tube 35 connects the conduit 27 to one of the volutes 13 or 14.

Figure 3:
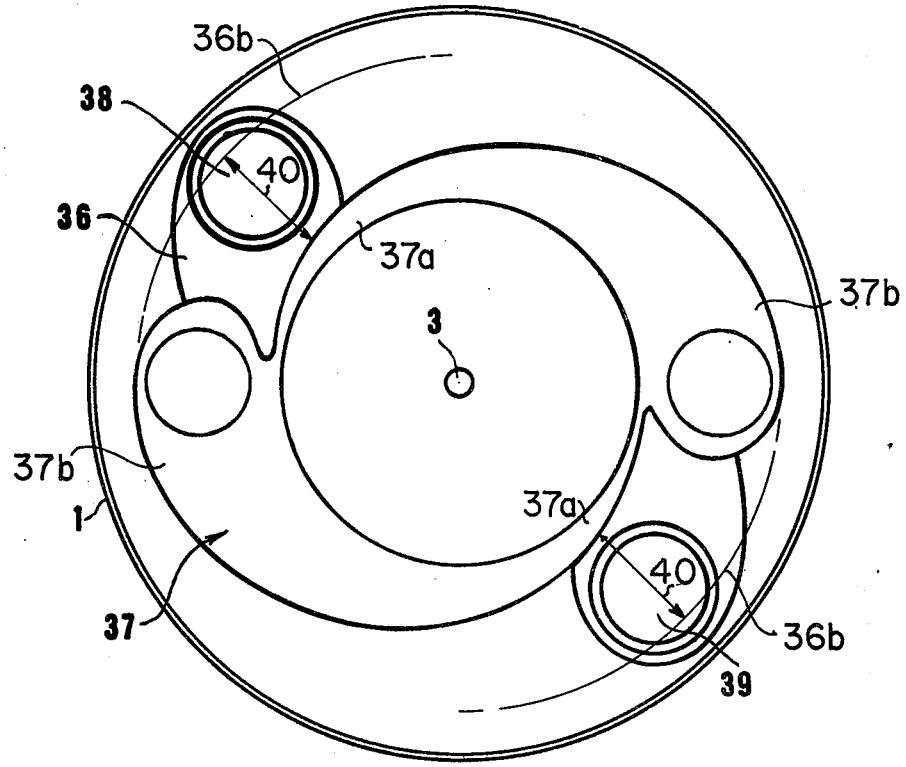
FIG. 3 is a transverse cross-sectional view of another embodiment of the invention.

FIG. 3 illustrates a simplified view in transverse cross-section of a sump pump according to the invention with volutes having two outlet nozzles to illustrate how it is thus possible to reduce the sump diameter to a minimum. An upper two-nozzle volute 37 is angularly staggered with respect to a lower two-nozzle volute 36 an angle relatively small in a manner such that the connections 38 and 39 between the volute outlet nozzles of the lower volute 36 and the manifold 10 pass in front of the tips of the nozzles of the upper volute 36.

The foregoing angular staggering as described above and shown in the drawing can also be described in terms of the configurations of the volutes. Of course, each volute is of a spirally, radially outwardly extending configuration with at least one radially innermost portion and at least one radially outermost portion. Reference character **36*b* designates the radially outermost portions of the lower volute 36 of FIG. 3. The radially innermost portions of the lower volute 36 are, of course, hidden from view in FIG. 3. The radially innermost portions of the upper volute 37 of FIG. 3 are designated by 37*a*, and the radially outermost portions of that volute are designated by 37*b*. It is, of course, readily apparent by the very nature of the spiral volute construction that the radially innermost and outermost portions of each volute are immediately adjacent to each other and that the differences in the radial extent of these portions will form a radial gap. In the device of FIG. 3 the radial gaps associated with the upper volute are designated by reference character 40.**

It is apparent from the drawing and from the foregoing description that the angular staggering as referred to above is a matter of the outlet in the radially outermost portion of the lower volute of each device being disposed immediately below the radial gap between the innermost and outermost portions of the upper volute.

Thus, each pipe connected with the outlet or outlets of the lower volute will extend through the one radial gap or one of the multiple radial gaps of the upper volute. It will also be readily apparent from the drawing that each pipe connected to the lower volute will extend in side-by-side relationship with a pipe connected to the upper volute.

It is besides obviously possible to provide impellers drawing out the liquid in the sump in a number greater than two.

The fact that the pipes 17 and 18 are individually removable not only facilitates assembly of the pump but makes it possible to use identical pump bodies 8 and 9 and, if another pump body is added, it may likewise be identical to bodies 8 and 9. The only change is in the length of the connection pipes to the manifold 10.

I claim:

1. A sump pump comprising:

a. a sump casing;

b. a single vertical driving shaft in said sump casing;

c. an upper impeller and a lower impeller, said impellers being mounted in vertically spaced disposition on said shaft, each impeller having a pair of intake means;

d. an upper volute and lower volute, each volute surrounding one impeller, each volute being of a spirally, radially, outwardly extending configuration with a radially innermost portion, a radially outermost portion and a radial gap between said innermost and outermost portions;

e. at least one outlet in the radially outermost portion of each volute;

f. said outlets and radially outermost portions being angularly staggered with respect to one another and so disposed that the outlet of said lower volute is immediately below said radial gap between said innermost and outermost portions of said upper volute; and g. a pair of pipe means, each pipe means being connected with one outlet, the one pipe means connected with the outlet of said lower volute extending through the region of said radial gap; whereby a radially compact arrangement is achieved.

2. A sump pump as defined in claim 1 wherein both of said pipe means extend vertically, in side by side relationship, from their associated outlet openings.

3. A sump pump as defined in claim 1 wherein:

a. each volute includes a pair of radially innermost portions, a pair of radially outermost portions and wherein a pair of radial gaps are defined therebetween, one radial gap being defined between one radially innermost portion and one radially outermost portion, the other radial gap being defined between the other radially innermost portion and the other radially outermost portion;

b. each volute includes a pair of outlets, one outlet of said pair being disposed in said one radially outermost portion of the volute, the other outlet of said pair being disposed in said other radially outermost portion of the volute; and c. said pair of outlets of said lower volute is angularly staggered with respect to said pair of outlets of said upper volute and so disposed that said outlets of said lower volute are immediately below said radial gaps of said upper volute.

4. A sump pump as defined in claim 1 wherein the combined number of outlets in said upper and lower volutes is an even number.

* * * * *

UNITED STATES PATENT OFFICE

CERTIFICATE OF CORRECTION

Patent No. 3,973,871 Dated August 10, 1976

Inventor(s) Pierre G. HANCE

It is certified that error appears in the above-identified patent and that said Letters Patent are hereby corrected as shown below:

In the covering page under "Foreign Application Priority Data", the number "806,614" should be changed to read --P.5461--.

Signed and Sealed this

First Day of February 1977

[SEAL]

*Attest:*

RUTH C. MASON
*Attesting Officer*

C. MARSHALL DANN
*Commissioner of Patents and Trademarks*